166-308 SR
1/13/87 XR 4,635,719

United States Patent [19]
Zoback et al.

[11] Patent Number: 4,635,719
[45] Date of Patent: Jan. 13, 1987

[54] METHOD FOR HYDRAULIC FRACTURE PROPAGATION IN HYDROCARBON-BEARING FORMATIONS

[76] Inventors: Mark D. Zoback, 716 Garland Dr., Palo Alto, Calif. 94303; Cecil B. Raleigh, P.O. Box DD, Palisades, N.Y. 10964

[21] Appl. No.: 822,051

[22] Filed: Jan. 24, 1986

[51] Int. Cl.[4] ..... E21B 43/26; E21B 47/06; E21B 49/00

[52] U.S. Cl. ..... 166/250; 166/308; 73/155

[58] Field of Search ..... 166/308, 250, 271, 259; 73/151, 155

[56] References Cited

U.S. PATENT DOCUMENTS

| | | | |
|---|---|---|---|
| 3,586,105 | 6/1971 | Johnson et al. | 166/250 |
| 4,220,205 | 9/1980 | Coursen et al. | 166/250 X |
| 4,440,226 | 4/1984 | Suman, Jr. | 166/250 X |
| 4,442,895 | 4/1984 | Lagus et al. | 166/250 |
| 4,453,595 | 6/1984 | Lagus et al. | 166/250 |
| 4,515,214 | 5/1985 | Fitch et al. | 166/250 |
| 4,577,689 | 3/1986 | Dotson | 166/250 |

*Primary Examiner*—Stephen J. Novosad
*Attorney, Agent, or Firm*—Kenyon & Kenyon

[57] ABSTRACT

A hydrocarbon-bearing strata in a hydrocarbon producing well is fractured using a fracture pressure which will not propagate the fracture into adjacent overlying and underlying non-producing strata. The least principal compressive stress $S_3$ of the hydrocarbon bearing strata and the adjacent overlying and underlying strata are determined by the relationship $$S_3 = \frac{S_1 - P_F}{[(u^2 + 1)^{\frac{1}{2}} + u]^2} + P_F$$

where $S_1$ is the maximum principle compressive stress, $P_F$ is the pore fluid pressure, and u is the coefficient of friction. The fracturing pressure is selected to be greater than $S_3$ for the hydrocarbon bearing strata but less than $S_3$ for the adjacent overlying and underlying non-producing strata. Hydrocarbon bearing formations suitable for hydraulic fracturing can also be identified.

12 Claims, 5 Drawing Figures

METHOD FOR HYDRAULIC FRACTURE PROPAGATION IN HYDROCARBON-BEARING FORMATIONS

FIELD OF THE INVENTION

The present invention is related to hydraulic fracture propagation in hydrocarbon-bearing formations in order to enhance fluid recovery from a well. More particularly, the present invention is related to an improved method for fracturing selected hydrocarbon bearing formations without fracturing adjacent overlying and underlying formations, and for selecting the hydraulic fracture propagation pressure to be used.

BACKGROUND OF THE INVENTION

The introduction of hydraulically driven extension fractures from wells into hydrocarbon-bearing formations to enhance the rate of the recovery of hydrocarbons is a well-known and common practice. Hydraulic fracturing of the well involves the raising of fluid pressure in a section of the well bore by pumping through perforations in the well casing, or, in open holes, by isolating the formation to be pressurized by the use of inflatable packers or some other means. Once initiated, a fracture will propagate when the stresses acting perpendicular to the fracture tip are exceeded by the fluid pressure within the fracture at that location.

It is desirable that the hydraulic fracture remains within the hydrocarbon-bearing formation and does not extend vertically into adjacent overlying and/or underlying non-hydrocarbon bearing formations or strata. Maintaining the hydraulic fracture within the hydrocarbon-bearing formation or strata results in gaining the maximum enhancement in productivity and avoiding the formation of a connection from the well borehole to formations likely to yield water to the producing well thereby diluting or even displacing the hydrocarbons flowing into the well. When the fracture propagates, usually generally vertically, into such overlying or underlying non-producing or water bearing horizons, in the worst case, the well may become non-productive and a new well will have to be drilled. Even in less damaging circumstances, the well may be much less productive than the anticipated enhancement would call for. In situations where the overlying or underlying strata will not produce water, it is still undesirable to propagate the fracture into such strata because the expenditures for creating the fracture will have been largely wasted on non-productive formations.

It is also very desirable to know the permissible fluid injection pressures for fracturing in advance because this will aid in the design of the fracture treatment, including the estimation of the number of pumping units required.

Hydraulically driven extension fractures will propagate when the fluid pressure in the fracture exceeds the least principal compressive stress, $S_3$, in the strata. Accordingly, when hydraulic fracturing is carried out, it is desired that the fluid pressure in the fracture be greater than the least principal compressive stress, $S_3$, of the hydrocarbon-bearing strata, but less than the least principal compressive stress, $S_3$, of both the adjacent overlying and underlying non-productive strata. Such conditions confine the hydraulically driven extension fractures to propagate only within the hydrocarbon-bearing strata.

For initiation of hydraulic fractures, the fluid pressure in the borehole must overcome the stress concentration produced by the presence of the hole in the rock strata and the tensile strength of the rock (see, e.g., M. K. Hubbert and D. G. Willis, 1957, Mechanics of Hydraulic Fracturing, AIME Trans., v. 210). Typically, the fluid pressure rises to a value exceeding $S_3$ before the fracture initiates. Upon propagation out to some distance exceeding a few well-bore diameters, the well-bore fluid pressure required for continued propagation will fall to a lower value, slightly above $S_3$. When, however, proppants are added to the fluid injected, as would typically be the case, high-velocity flow with attendant large pressure drop along the fracture is necessary to maintain the proppant in suspension. Thus, it is highly desirable that the injection pressure be as great as possible but still less than that required to propagate the fracture into the overlying or underlying strata.

Methods for measuring the state of stress in hydrocarbon-bearing formations which involve the hydraulic fracturing process itself have been widely reported in the literature. $S_3$ can be readily determined by measuring the fluid pressure at which fracture propagation ceases. The most common measuring technique is as follows. First, initiate the fracture by pumping to increase the fluid pressure. Then shut off the fracturing pump. The fluid pressure drops sharply because of continuing flow into the fracture. Upon closure of the fracture, the fluid pressure ceases to fall rapidly and this, so-called, instantaneous shut-in pressure, ISIP, is taken to be the least principal compressive stress, $S_3$.

Therefore, the least principal compressive stress $S_3$. of the hydrocarbon-bearing strata or formation can be determined readily once the hydraulic fracturing operation is completed. The least principal compressive stress of the non-productive overlying and underlying strata are not measured in normal practice. It is significant to bear in mind that although the least principal compressive stress $S_3$ of the hydrocarbon-bearing strata or formation can be measured once a hydraulic fracture operation is completed, $S_3$ is not known in advance. It is a costly undertaking to hydraulically fracture each formation for direct measurement of $S_3$ prior to hydraulically fracturing the hydrocarbon-bearing formation of the well.

A common commercial method used to predict stress state is known as FracHite which is proprietary to Schlumberger Technology Corporation. This method relies upon an equation which yields $S_3$ incorporating the parameters of depth and density to yield the vertical stress, Sv, and Poisson's ratio, v, which is given by measurement of the compressional and shear wave velocities in the formations from wire-line sonic logging methods and a number of other parameters. For example, the predictive algorithm includes estimates of the vertical stress intensity factor or fracture toughness. The FracHite method requires the principal assumption that the horizontal stress within the formations is generated by confinement at some distant vertical boundary of the lateral Poisson's expansion caused by the superincumbent loading of the overlying sedimentary rock.

The present invention involves the discovery that this commercial method and its assumptions can be improved upon for providing $S_3$ predictions in some of the most productive oil and gas provinces of the United States and elsewhere.

OBJECTS OF THE INVENTION

It is therefore an object of the present invention to provide an improved method for the hydraulic fracturing of selected hydrocarbon bearing formations without fracturing adjacent overlying or underlying formations, and for selecting the hydraulic fracture propagation pressure to be used.

It is a further object of the present invention to provide a method for determining the fluid pressure required to propagate a hydraulic fracture in a hydrocarbon-bearing formation while confining the fracture within the desired formation.

It is another object of the present invention to provide a method for selecting the fluid pressure which will propagate hydraulic fractures in a hydrocarbon-bearing strata but will not propagate the hydraulic fracture into the adjacent overlying and underlying non-productive strata.

It is still another object of the present invention to provide an improved method for determining if a hydrocarbon bearing formation is suitable for fracturing.

These and other objects of the present invention will become apparent from the following description and claims in conjunction with the drawings.

SUMMARY OF THE INVENTION

In accordance with the present invention, it has been discovered that the least horizontal principal compressive stress, $S_3$, of a formation or strata, and therefore the required hydraulic fracture pressure, can be predicted based upon the maximum principal compressive stress, the pore fluid pressure, and the coefficient of friction of the formation. This discovery is especially applicable in regions of normal faulting equilibrium in which the maximum principal stress, $S_1$, is vertical. More particularly, in accordance with the present invention, the least principal compressive stress is determined by the formula:

$$S_3 = \frac{S_1 - P_F}{[(u^2 + 1)^{\frac{1}{2}} + u]^2} + P_F,$$

where $S_3$ is the least principal compressive stress of the formation which is to be predicted in accordance with the invention;

$S_1$ is the maximum principal compressive stress of the formation;

$P_F$ is the pore fluid pressure of the formation; and u is the coefficient of friction of the formation.

In accordance with the present invention, $S_3$ would be determined for the hydrocarbon-bearing formation or strata to be fractured and also for the adjacent overlying and underlying non-producing formation or strata. The hydrocarbon-bearing formation is then fractured using a pressure greater than the determined $S_3$ for the hydrocarbon-bearing formation and less than the determined $S_3$ for the adjacent overlying and underlying formations.

The least principal compressive stresses $S_3$ determined in accordance with the present invention may also be employed to identify a hydrocarbon bearing formation that is a suitable candidate for fracturing.

The present invention is particularly applicable for geological areas where stress states are ones of normal faulting equilibrium, or where $S_1$ is known.

BRIEF DESCRIPTION OF THE DRAWINGS

In the drawings forming part hereof.

DETAILED DESCRIPTION

In order to provide a more complete understanding of the present invention and an appreciation of its advantages, a detailed description of the method of the present invention is set forth below.

Hydraulic fracturing of hydrocarbon-bearing formations in hydrocarbon producing wells is well known and the particular technique used to provide the pressure to cause the propagation of the hydraulically driven extension fractures into the hydrocarbon bearing formation is not the concern of the present invention. The present invention relates to the determination and selection of the hydraulic pressure to be used so as to cause fracture of the hydrocarbon-bearing formation and avoid propagation of the fractures vertically into the overlying and underlying non-producing formations. The particular hydraulic fracturing technique employed will be determined by one skilled in the art depending upon the particular circumstances.

In accordance with the present invention, the hydraulic pressure to be used to fracture a hydrocarbon-bearing formation in a hydrocarbon producing well is determined by ascertaining the least principal compressive stress, $S_3$, in both that formation and in the overlying and underlying non-hydrocarbon producing formations using the equation:

$$S_3 = \frac{S_1 - P_F}{[(u^2 + 1)^{\frac{1}{2}} + u]^2} + P_F$$

where $S_1$ is the maximum principal compressive stress, $S_3$ is the least principal compressive stress, $P_F$ is the formation pore fluid pressure, and u is the coefficient of friction for the particular formation or strata.

Figure 1:
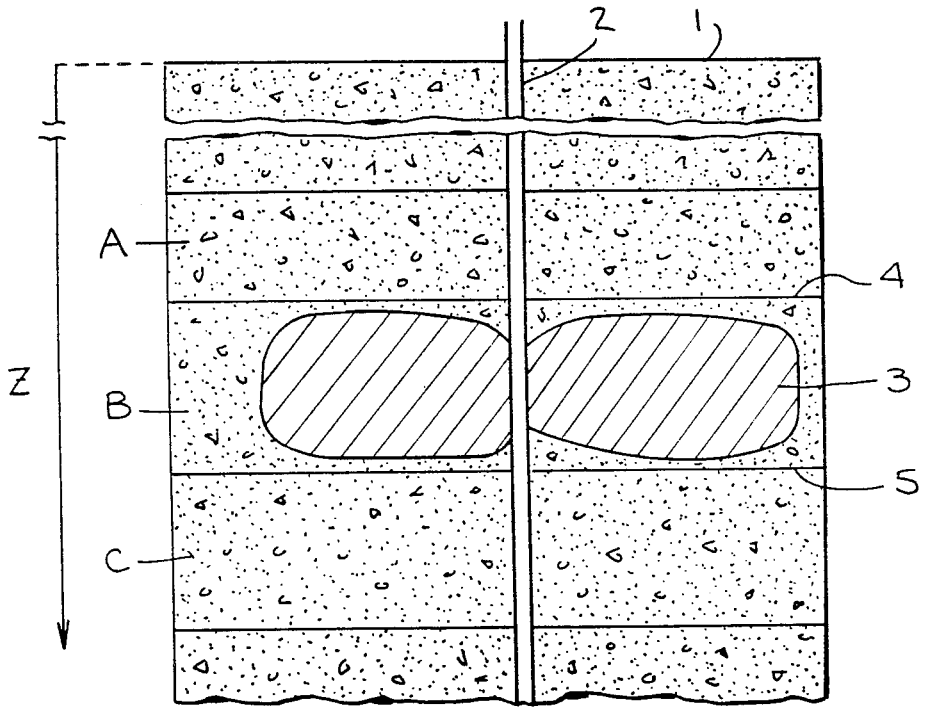
FIG. 1 is a schematic vertical cross-sectional view of a hydrocarbon producing well having a hydrocarbon-bearing formation to be fractured.

FIG. 1 schematically illustrates a hydrocarbon producing well. B represents a hydrocarbon-bearing formation or strata. A represents an adjacent overlying bounding non-producing formation or strata and C represents an adjacent underlying bounding non-producing formation or strata. The surface of the earth is designated as 1 and the well bore is designated as 2. The zone of hydraulic fracture 3 is illustrated by cross-hatching in the figure. As previously discussed, a fracture will propagate when stresses acting perpendicular to the fracture are exceeded by the fluid pressure within it. It is also appreciated by one skilled in the art that hydraulically driven extension fractures propagate in both the horizontal and vertical directions. It is also known that the fractures propagate when the fluid pressure in a strata or formation exceeds the least principal compressive stress, $S_3$, thereof. As previously discussed, it is undesirable for the fractures to propagate vertically from the productive strata B into the bounding non-productive horizontal strata A and C because this will degrade the productivity of the well and in worst cases virtually destroy the productivity of the well.

By way of example, the hydrocarbon-bearing strata B may be sandstone and the non-productive bounding strata A and C may be shale. Typically, the shallowest hydrocarbon producing formation B is at least 2000 feet below the surface of the earth 1 and frequently is much greater. The vertical height of the hydrocarbon-producing formation B is typically on the order of approximately 10 feet to approximately 100 feet.

Accordingly, the present invention is used to determine $S_3$ for formations or stratas A, B, and C referred to herein as $S_3(A)$, $S_3(B)$ and $S_3(C)$. Upon making this determination using the equation hereinbefore set forth, the hydrocarbon-bearing formation B is hydraulically fractured using a pressure greater than $S_3(B)$ but less than the lesser of $S_3(A)$ or $S_3(C)$. Use of this pressure for fracturing prevents the undesired propagation of the hydraulically induced fractures vertically into the non-productive stratas A and C. Determination of $S_3$ in accordance with the present invention will hereinafter be discussed in detail. It will become readily apparent to one skilled in the art that the method of the present invention is applicable to wells having more than one hydrocarbon-bearing strata where each hydrocarbon-bearing strata is bounded by an overlying and underlying non-productive strata.

The method of the present invention applies to all regions of active crustal extension including the Basin and Range Province of the western United States, many continental margins, as well as other well-known sedimentary basins. The invention is particularly applicable to geological areas where the stress states are one of normal faulting equilibrium. A well known example is the Gulf Coast oil and gas province of the southern United States. Geologic evidence of active but slowly moving normal faults throughout the Gulf coastal plain shows that the region is in a condition of normal fault equilibrium with stable sliding on faults dipping toward the Gulf of Mexico. The fault motion results in extension of the region along directions generally perpendicular to the coast line and implies a state-of-stress in which the vertical component $S_v$ is the greatest principal compressive stress $S_1$. The least principal compressive stress, $S_3$, is approximately horizontal and perpendicular to the coastline. It is known in the art that stable sliding on faults occurs when the shear stress, t, in the direction of slip exceeds the frictional strength which is the product of the normal stress, $S_n$, less the internal fluid pressure, $P_F$, multiplied by the coefficient of friction, u, or, $$t_{sliding}=(S_N-P_F)u.$$

For conditions of normal faulting equilibrium, the foregoing expression may be rewritten in terms of the principal compressive stresses $S_1$ ($S_1=S_v$) and $S_3$ as:

$$S_3=\frac{S_1-P_F}{[(u^2+1)^{\frac{1}{2}}+u]^2}+P_F,$$

with the intermediate principal stress, $S_2$, in the plane of the fault and thus if the ratio of the effective principal stresses, $S_1$ and $S_3$, on the left hand side of the equation is less than on the right, no sliding will occur; if greater, sliding would occur until the stresses relaxed again to near the equilibrium stable sliding value.

The equation used in predicting the least principal compressive stress, $S_3$, and for determining hydraulic fracture pressure in accordance with the present invention, is a two-dimensional form derived from a generalized three-dimensional equation. The two-dimensional form is quite adequate for the practical purposes of the present invention but one skilled in the art could readily generalize the equation to a three-dimensional form if he desired to do so or if he believed specific circumstances warranted such a generalization in accordance with the teachings of the present invention.

The value of the coefficient of friction u can be determined from known laboratory procedures and measurements familiar to one skilled in the art. It is known to those skilled in the art from laboratory and field experiments that reasonable values of u for most rocks lie within the range of 0.6 to 1.0. Accordingly, it is possible to make reasonable estimates of u for practice of the invention. However, u appropriate to a given sedimentary sequence can be determined by laboratory tests performed on cores from holes drilled in the basin. It is pointed out that in many instances, calculated values of $S_3$ will not be highly sensitive to reasonable estimated values of u made by one skilled in the art.

The pore fluid pressure $P_F$ may be measured by known methods or it may be estimated for a given type formation or strata by one skilled in the art. A commonly used technique for measurement of pore fluid pressure $P_F$ is the use of a Schlumberger repeat formation tester. For shale formations or strata, which frequently bound hydrocarbon-bearing formations, direct measurement of pore fluid pressure, $P_F$, is an extremely difficult undertaking at the current level of skill in the art. This is because shale is substantially impermeable. Estimating pore fluid pressure, $P_F$, for shale is within the skill of the art and such estimation is satisfactory for the practice of the invention. The estimation of pore fluid pressure, $P_F$, for various type formations may be determined empirically from logging data.

The principal compressive stress $S_1$ for a given strata is calculated from the equation:

$$S_1=S_v=pgz$$

where p is the density of the overlying stratas, g is the acceleration of gravity, and Z is the vertical distance from the surface of the earth to the formation for which $S_1$ is to be determined. Simply stated, Z is the depth at which $S_1$ is to be calculated. The use of the foregoing equation to calculate the principal compressive strength of a formation at a given depth is a common practice in the art. The value of density, p, for use in the equation for calculating $S_1$ is typically accomplished by estimating p of the overlying sedimentary rocks using well log data. This is also a common practice in the art.

With reference to FIG. 1, the invention is practiced as follows. The values of p, u, Z and PF are determined to calculate $S_1(A)$, $S_1(B)$, and $S_1(C)$ followed by the calculation of $S_3(A)$, $S_3(B)$, and $S_3(C)$. Typically, the same value of p and u are employed for strata A, B, and C whereas $P_F$ is different for strata B (hydrocarbon-bearing) than for bounding strata A and C. Fracturing takes place, in accordance with the invention, at a pressure greater than $S_3(B)$ but less than the lesser of $S_3(A)$ and $S_3(C)$.

A more specific example is as follows. The depth from the surface to the approximate midpoint of hydrocarbon-bearing strata B is Z=4000 meters. The value of u in the strata A, B and C is taken to be u =0.8 and the density p=2.3 gm/cm$^3$ is used for strata A, B, and C and for all the rock units above those strata. Strata B (hydrocarbon-bearing) is sandstone and is normally pressurized (i.e., hydrostatic fluid pressure). $P_F$ for the sandstone strata B is estimated to be $P_F$=0.465 $S_1$. The bounding strata A and C (non-producing strata) are shales with greater than hydrostatic fluid pressure and $P_F$ for strata A and C is estimated to be $P_F$=0.95 $S_1$. $S_1$ is calculated for each strata using Z=4000 meters for the $S_1$ calculation of each strata. Thereafter $S_3$ is calculated with $S_3(B)$=533 bars. $S_3(A)$ and $S_3(C)$=870 bars. Thus, the injection pressure at the depth of the horizon or strata B (hydrocarbon-bearing) to be hydrulically fractured is greater than 533 bars and less than 870 bars. Such pressure will cause hydraulic fracture propagation in strata B but avoid undesired hydraulic fracture propagation is strata A and C.

The depth of 4000 meters, which is the approximate mid-point of hydrocarbon-bearing strata B (i.e., Z=4000 meters) was used for the calculation of $S_1$ in strata A, B, and C because as hereinbefore discussed, the vertical width of a hydrocarbon bearing strata, such as B, is typically small e.g., 10–100 ft, compared to its depth. No substantial practical improvement would result from use of exact values of Z for each of strata A, B, C.

For more exact computation, which as a practical matter would not be frequently required, $Z_A$, $Z_B$ and $Z_C$ would be determined for the computation of $S_1(A)$, $S_1(B)$, and $S_1(C)$ respectively. $Z_A$ would be the depth of the boundary 4 (FIG. 1) between strata A and strata B. $Z_C$ would be the depth of the boundary 5 between strata C and strata B. $Z_B$ would be the depth at the approximate midpoint of hydrocarbon-bearing strata B. Selecting such individual Z's would give more precise results, but in many practical applications is not required.

It will be appreciated that when the hydraulic fracturing pressure is determined for one well, this fracturing pressure or approximately the same fracturing pressure could then be used for another well where the hydrocarbon bearing strata, and the associated overlying and underlying strata have characteristics that would result in $S_3$'s approximately the same as the $S_3$'s of the initial well.

The method of the present invention can also be used to identify a hydrocarbon bearing formation in a well which is a suitable candidate for hydraulic fracturing. If the least principal compressive stresses $S_3$ of the overlying or underlying strata are not sufficiently greater than the least principal compressive stress $S_3$ of the hydrocarbon bearing formation, the hydrocarbon bearing formation would not be a suitable candidate for hydraulic fracturing. It will be appreciated that the fracture would be prone to readily propagate into an overlying or underlying non-productive strata which had a least principal compressive stress close to that of the bounded hydrocarbon bearing strata. As a general practical matter, the least principal compressive stress $S_3$ of the overlying and underlying non-productive strata is typically at least approximately 100 psi greater than the least principal compressive stress $S_3$ of the bounded hydrocarbon-bearing strata in order for the hydrocarbon-bearing strata to be a suitable candidate for hydraulic fracture.

Figure 2:
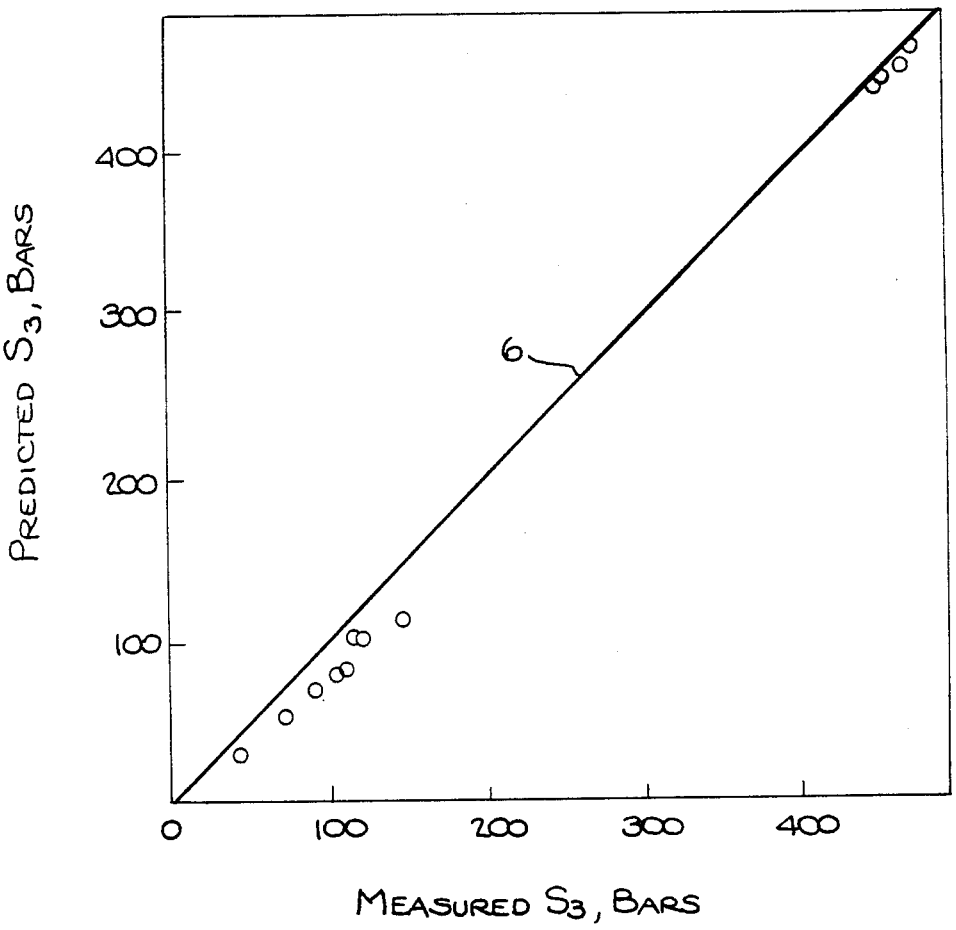
FIG. 2 is a graph comparing predicted values of $S_3$ in accordance with the present invention with actual measured values of $S_3$.

FIG. 2 illustrates the accuracy of the method of the present invention. In FIG. 2, the straight line 6 illustrates the predicted value of $S_3$ in bars using the equation for prediction of $S_3$. The small circles indicate the actual measured value of $S_3$. That is, FIG. 2 compares predicted and measured values of $S_3$. A very good correlation is seen between the measured and predicted values. The data of the lower left of FIG. 2 represent predictions when rough measurements of $P_F$ were made. The data of the upper right of FIG. 2 represent predictions when good measurements of $P_F$ were made.

The data in the lower left of FIG. 2 are derived from J. M. Stock et al., "Hydraulic Fracturing Stress Measurements At Yucca Mountain Nevada, And Relationship To The Regional Stress Field," Journal of Geophysical Research, Vol. 90, pp. 8691–8706, Sept. 10, 1985. The data in the lower left of FIG. 2 are from south central Nevada and are set forth in Table I.

TABLE I

| | Z | u | $S_1$ | $P_F$ | $S_3(P)$ | $S_3(M)$ |
|---|---|---|---|---|---|---|
| 1. | 646 | 0.8 | 129 | 7 | 35 | 42 |
| 2. | 792 | 0.8 | 159 | 22 | 54 | 72 |
| 3. | 945 | 0.8 | 192 | 36 | 72 | 90 |
| 4. | 1026 | 0.8 | 210 | 49 | 86 | 111 |
| 5. | 1038 | 0.8 | 214 | 45 | 84 | 106 |
| 6. | 1209 | 0.8 | 255 | 67 | 110 | 120 |
| 7. | 1218 | 0.8 | 255 | 63 | 107 | 121 |
| 8. | 1288 | 0.8 | 272 | 70 | 117 | 148 |

$S_3(P)$ is the predicted $S_3$ in bars. $S_3(M)$ is measured $S_3$ in bars. Z is depth in meters, u is coefficient of friction, $S_1$ is the greatest principal stress in bars, and $P_F$ is pore fluid pressure in bars.

The data in the upper right of FIG. 2 are data from Piceance Basin, Colo. This data are set forth in Table II and are taken from N. R. Warpinski et al., "In-Situ Stress Measurements at DOE's Multiwell Experimental Site, Mesaverde Group, Rifle, Colo.," Society of Petroleum Engineers, 12142, 1983, Society of Petroleum Engineers of AIME.

TABLE II

| | Z | | | | | $S_3(P)$ | | $S_3(M)$ | |
|---|---|---|---|---|---|---|---|---|---|
| | ft | m | u | $S_1$ | $P_F$ | bars | psi | bars | psi |
| 1. | 7849 | 2393 | 0.8 | 569 | 424 | 457 | 6634 | 458 | 6645 |
| 2. | 7892 | 2406 | 0.8 | 572 | 434 | 466 | 6760 | 471 | 6830 |
| 3. | 7921 | 2415 | 0.8 | 574 | 434 | 467 | 6767 | 472 | 6850 |
| 4. | 7970 | 2430 | 0.8 | 577 | 434 | 472 | 6847 | 475 | 6885 |

Again in Table II, $S_3(P)$ is the predicted $S_3$ and $S_3(M)$ is the measured $S_3$ and they are set forth both in bars and psi. The units of p, u, and $P_F$ are the same as for Table I. The depth Z is given in both meters and feet.

Figure 3:
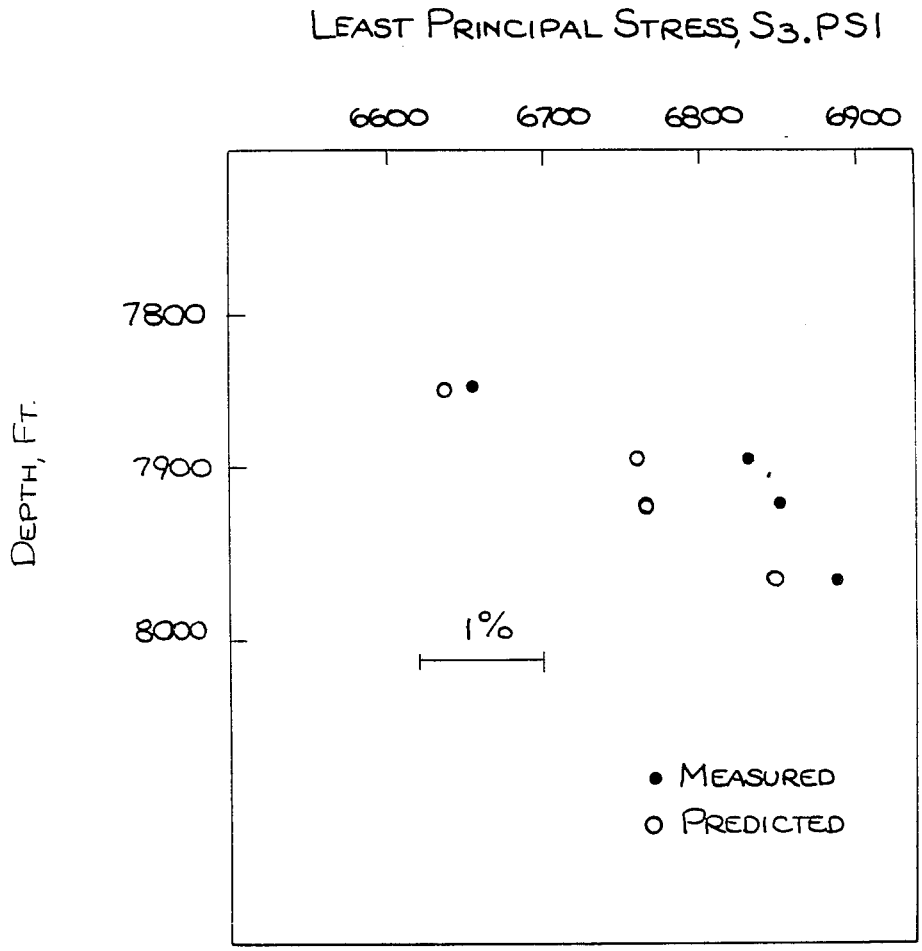
FIG. 3 is a graphical representation of the accuracy of the predicted $S_3$ which may be achieved by the present invention.

The data of the upper right of FIG. 2 set forth in Table II are illustrated in more detail in FIG. 3 and demonstrate the high degree of accuracy of the method of the present invention when good measurements of $P_F$ are made. In FIG. 3 the least principal compressive stress, $S_3$, in psi is plotted versus depth in feet. The small circles indicate predicted values of $S_3$. The solid dots indicate the measured values of $S_3$. The predicted values of $S_3$ are within about 1% of the measured values of $S_3$.

Figure 4:
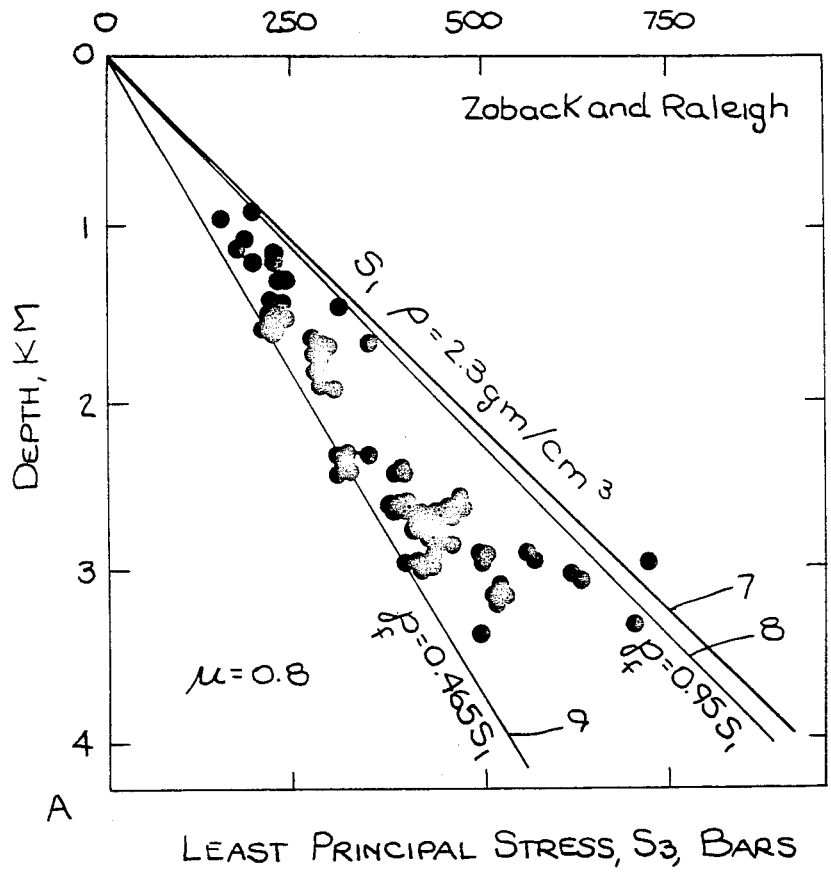
FIG. 4 is a graph illustrating that, in general, for a typical coefficient of friction, u, (0.8) and for a typical range experienced for pore fluid pressure, $P_F$, ($0.465S_1$–$0.95S_1$) predicted values of $S_3$ are within the range of measured values of $S_3$; and, FIG. 5 is a graph illustrating that for a typical low end of a range of pore fluid pressures ($0.465S_1$), $S_3$ predictions are not highly sensitive to a typical range of values of the coefficient of friction, u, (0.6–1.0).

FIG. 4 further illustrates the general usefulness of the present invention in predicting least principal compressive stress, $S_3$, when general typical estimated values of pore fluid pressure $P_F$ are used. FIG. 4 illustrates with black dots actual measured least principle compressive stress, $S_3$, in bars versus the depth in kilometers for the Gulf Coastal region of Texas and Louisiana. The measured values of $S_3$ presented in FIG. 4 are published in *Hydraulic Fracturing,* G. C. Howard and C. R. Fast, Monograph Series No. 2 of the Society of Petroleum Engineers of AIME, p. 6 (1970).

The principal compressive stress, $S_1$, is illustrated in FIG. 4 as line 7 and is based upon an estimated density, p, of 2.3 grams/cm$^3$. That is, $S_1=2.3$ grams/cm$^3$gZ. The value of the coefficient of friction in FIG. 4 is taken to be u=0.8. Reasonable typical estimates of maximum and minimum pore fluid pressure values $P_F$ were made. Estimated minimum pore fluid pressure is $P_F=0.465\ S_1$. Estimated maximum pore fluid pressure is $P_F=0.95\ S_1$. These general estimates are used to predict maximum and minimum $S_3$ versus depth. Maximum predicted least principal compressive stress, $S_3$, is represented by line 8. Minimum predicted least principal compressive stress, $S_3$, is represented by line 9. Actual measured $S_3$ indicated by the black dots reasonably demonstrate that the actual measured $S_3$ falls between the maximum and minimum predicted $S_3$ using reasonable typical estimates of $P_F$. If $P_F$ is measured or a specific reasonable estimate of $P_F$ is made for the actual site of the $S_3$ determination, accurate predictions of least principal compressive stress, $S_3$, can be made.

Figure 5:
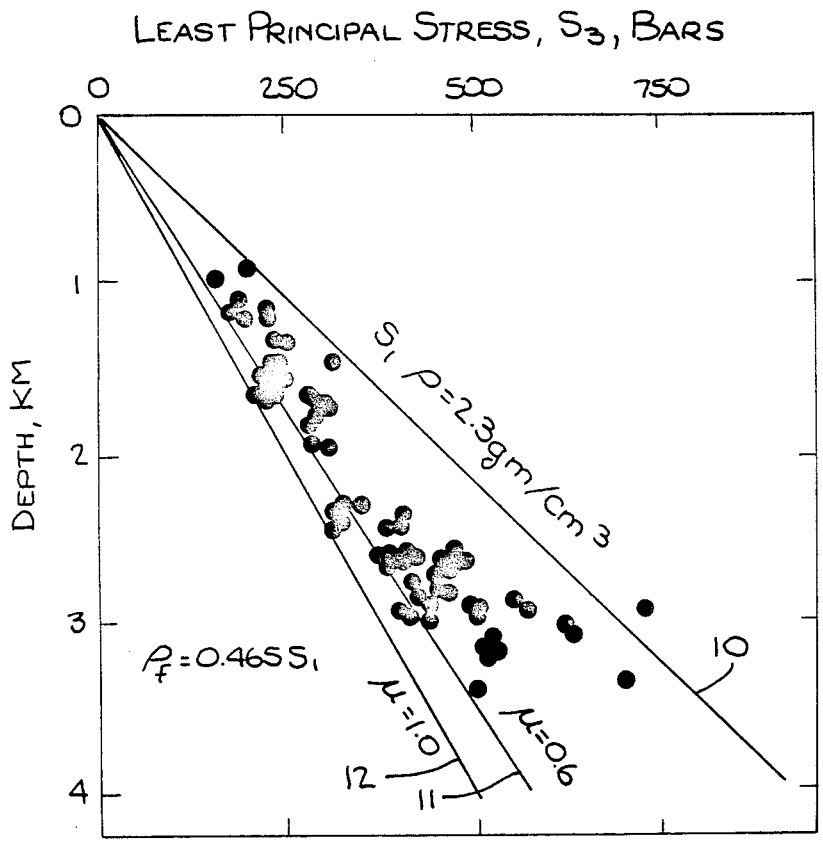

FIG. 5 illustrates that the method of the present invention is not highly sensitive to reasonable values of a typical range of the coefficient of friction u. The actual measure values of $S_3$ of FIG. 4 (depth in Km versus stress in bars) are again represented by dots in FIG. 5. Line 10 again illustrates the principal compressive stress, $S_1$, using a density value of p=2.3 grams/cm$^3$. In FIG. 5, $P_F$ is taken as 0.465 $S_1$ representing a minimum reasonable general estimated value for $P_F$. Line 11 illustrates predicted $S_3$ when u is taken as 0.6. Line 12 illustrates predicted $S_3$ when u is taken as 1.0.

Although preferred embodiments of the present invention have been described in detail, it is contemplated that modifications may be made by one skilled in the art all within the spirit and the scope of the present invention.

What is claimed is:

1. A method of hydraulically fracturing a hydrocarbon-bearing strata in a hydrocarbon producing well comprising:

providing a hydrocarbon-producing well having a hydrocarbon bearing strata, a bounding non-producing strata overlying the hydrocarbon-bearing strata, and a bounding non-producing strata underlying the hydrocarbon-producing strata;

determining the maximum principal compressive stress $S_1$ for the hydrocarbon-bearing strata, the overlying bounding non-producing strata, and the underlying bounding non-producing strata;

determining the pore fluid pressure $P_F$ for the hydrocarbon-bearing strata, the overlying bounding non-producing strata, and the underlying bounding non-producing strata;

determining the coefficient of friction u for the hydrocarbon-bearing strata, the overlying bounding non-producing strata, and the underlying bounding non-producing strata;

determining the least principal compressive stress $S_3$ for the hydrocarbon-bearing strata, the overlying bounding non-producing strata, and the underlying bounding non-producing strata using the equation:

$$S_3 = \frac{S_1 - P_F}{[(u^2 + 1)^{\frac{1}{2}} + u]^2} + P_F$$

using the respective determined values of $S_1$, $P_F$, and u for said respective determinations of $S_3$;

hydraulically fracturing the hydrocarbon-bearing strata with a fracturing pressure selected greater than said determined $S_3$ for the hydrocarbon-bearing strata and less than the $S_3$ determined for the overlying bounding non-producing strata and the underlying bounding non-producing strata.

2. A method according to claim 1 wherein $S_1$ for the hydrocarbon-bearing strata, the overlying bounding strata, and the underlying bounding strata is determined by the formula $S_1=pgZ$ where p is density, g is the acceleration of gravity and Z is depth.

3. A method according to claim 2 wherein the same p and Z are used for determining $S_1$ in the hydrocarbon-bearing strata, the overlying bounding strata and the underlying bounding strata.

4. A method according to claim 1 wherein said well has more than one hydrocarbon-bearing strata and each hydrocarbon bearing strata has associated therewith a bounding overlying non-producing strata and a bounding underlying non-producing strata.

5. A method according to claim 4 wherein said well is located in an area where stress states are those of normal faulting equilibrium.

6. A method according to claim 1 wherein said well is located in an area where stress states are those of normal faulting equilibrium.

7. A method for ascertaining that a hydrocarbon-bearing strata in a hydrocarbon producing well is suitable for hydraulic fracturing comprising:

providing a hydrocarbon-producing well having a hydrocarbon bearing strata, a bounding non-producing strata overlying the hydrocarbon-bearing strata, and a bounding non-producing strata underlying the hydrocarbon-producing strata;

determining the principal compressive stress $S_1$ for the hydrocarbon-bearing strata, the overlying bounding non-producing strata, and the underlying bounding non-producing strata;

determining the pore fluid pressure $P_F$ for the hydrocarbon-bearing strata, the overlying bounding non-producing strata, and the underlying bounding non-producing strata;

determining the coefficient of friction u for the hydrocarbon-bearing strata, the overlying bounding non-producing strata, and the underlying bounding non-producing strata;

determining the least principal compressive stress $S_3$ for the hydrocarbon-bearing strata, the overlying bounding non-producing strata, and the underlying bounding non-producing strata using the equation:

$$S_3 = \frac{S_1 - P_F}{[(u^2 + 1)^{\frac{1}{2}} + u]^2} + P_F$$

using the respective determined values of $S_1$, $P_F$, and u for said respective determinations of $S_3$;

comparing the determined $S_3$ for the hydrocarbon bearing strata with the determined $S_3$ for the overlying bounding non-producing strata and the underlying bounding non-producing strata to ascertain the suitability of the hydrocarbon bearing strata for fracture.

8. A method according to claim 7 further comprising hydraulically fracturing the hydrocarbon bearing strata if $S_3$ for the overlying bounding non-producing strata and the underlying bounding non-producing strata is sufficiently greater than $S_3$ for the hydrocarbon bearing strata to permit hydraulic fracturing.

9. A method according to claim 7 further comprising hydraulically fracturing the hydrocarbon bearing strata if $S_3$ for the overlying bounding non-producing strata and the underlying bounding non-producing strata is at least approximately 100 psi greater than $S_3$ for the hydrocarbon bearing strata.

10. A method according to claim 7 further comprising refraining from hydraulically fracturing the hydrocarbon bearing strata if $S_3$ for the overlying bounding non-producing strata and the underlying bounding non-producing strata is insufficiently greater than $S_3$ for the hydrocarbon bearing strata to permit fracturing.

11. A method according to claim 7 further comprising refraining from hydraulically fracturing the hydrocarbon bearing strata if $S_3$ for the overlying bounding non-producing strata and the underlying bounding non-producing strata is less than approximately 100 psi greater than $S_3$ for the hydrocarbon bearing strata.

12. A method of hydraulically fracturing a hydrocarbon-bearing strata in a hydrocarbon producing well comprising:

providing one hydrocarbon-producing well having a hydrocarbon bearing strata, a bounding non-producing strata overlying the hydrocarbon-bearing strata, and a bounding non-producing strata underlying the hydrocarbon-producing strata;

determining the principal compressive stress $S_1$ for the hydrocarbon-bearing strata, the overlying bounding non-producing strata, and the underlying bounding non-producing strata of said one hydrocarbon producing well;

determining the pore fluid pressure $P_F$ for the hydrocarbon-bearing strata, the overlying bounding non-producing strata, and the underlying bounding non-producing strata of said one hydrocarbon producing well;

determining the coefficient of friction u for the hydrocarbon-bearing strata, the overlying bounding non-producing strata, and the underlying bounding non-producing strata of said one hydrocarbon producing well;

determining the least principal compressive stress $S_3$ for the hydrocarbon-bearing strata, the overlying bounding non-producing strata, and the underlying bounding non-producing strata of said one hydrocarbon producing well using the equation:

$$S_3 = \frac{S_1 - P_F}{[(u^2 + 1)^{\frac{1}{2}} + u]^2} + P_F$$

using the respective determined values of $S_1$, $P_F$, and u for said respective determinations of $S_3$;

hydraulically fracturing the hydrocarbon-bearing strata of said one hydrocarbon producing well with a fracturing pressure selected greater than said determined $S_3$ for the hydrocarbon-bearing strata and less than said determined $S_3$ for the overlying bounding non-producing strata and the underlying bounding non-producing strata of said one hydrocarbon producing well;

providing another hydrocarbon producing well having a hydrocarbon bearing strata, a bounding non-producing strata overlying the hydrocarbon bearing strata, and bounding non-producing strata underlying the hydrocarbon bearing strata wherein $S_3$ for said hydrocarbon bearing strata, said overlying bounding non-producing strata, and said underlying bounding non-producing strata of said another well are ascertained to be approximately the same as $S_3$ for said hydrocarbon bearing strata, said overlying bounding non-producing strata, and said underlying bounding non-producimg strata of said one well;

hydraulically fracturing said hydrocarbon bearing strata of said another well with a fracturing pressure approximately the same as the fracturing pressure used to fracture said hydrocarbon bearing strata of said one well.

* * * * *